US006827294B1

(12) United States Patent
Fan et al.

(10) Patent No.: US 6,827,294 B1
(45) Date of Patent: Dec. 7, 2004

(54) EXTERNAL SUPPLY SYSTEM

(76) Inventors: Huan-Chang Fan, 58, Ma Yuan West St., Taichung (TW); Tzu-Chieh Chan, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/452,595

(22) Filed: May 29, 2003

(51) Int. Cl.[7] ..... A47K 5/12; E03C 1/05

(52) U.S. Cl. ..... 239/310; 239/289; 239/315; 4/623; 222/192; 222/383.1

(58) Field of Search ..... 239/67, 69, 71, 239/289, 310, 314–316; 4/623, 619, 903; 251/129.15, 129.04; 222/192, 173, 383.1; D23/209

(56) References Cited

U.S. PATENT DOCUMENTS 2,477,998 A * 8/1949 McCowan ..... 239/310
2,529,365 A * 11/1950 Barksdale ..... 222/181.2
3,168,353 A * 2/1965 Horowitz ..... 303/13
3,639,920 A * 2/1972 Griffin et al. ..... 4/623
3,713,585 A * 1/1973 Conklin ..... 239/307
4,295,233 A * 10/1981 Hinkel et al. ..... 4/619
4,398,310 A * 8/1983 Lienhard ..... 4/623
4,606,085 A * 8/1986 Davies ..... 4/623
4,625,896 A * 12/1986 Rocchelli ..... 222/180
4,839,039 A * 6/1989 Parsons et al. ..... 210/143
5,031,258 A * 7/1991 Shaw ..... 4/623
5,165,576 A * 11/1992 Hickerson ..... 222/158
5,199,118 A * 4/1993 Cole et al. ..... 4/619
5,625,908 A * 5/1997 Shaw ..... 4/623
5,765,242 A * 6/1998 Marciano ..... 4/623
5,781,942 A * 7/1998 Allen et al. ..... 4/623
6,016,936 A * 1/2000 Fan ..... 222/181.1
6,119,285 A * 9/2000 Kim ..... 4/665

FOREIGN PATENT DOCUMENTS

JP 2-85430 * 2/1990 ..... 4/623

* cited by examiner

*Primary Examiner*—Patrick Brinson

(57) ABSTRACT

An external supply system includes a sensing device to provide flush water automatically, and a supply device to provide cleaning liquid. The supply device is connected to the sensing device to provide the flush water and the cleaning liquid. Thus, the supply device co-operates with the sensing device to provide the cleaning agent and the flush water synchronously, thereby facilitating the user washing and cleaning the object.

1 Claim, 5 Drawing Sheets

EXTERNAL SUPPLY SYSTEM

BACKGROUND OF THE INVENTION

1. Field of the Invention

The present invention relates to an external supply system, and more particularly to an external supply system, wherein the supply device co-operates with the sensing device to provide the cleaning agent and the flush water synchronously, thereby facilitating the user washing and cleaning the object.

2. Description of the Related Art

A conventional supply device 40 in accordance with the prior art shown in FIG. 6 contains liquid, such as the cleaning agent or the like therein. In arrangement, the supply device 40 is spaced away from the faucet 50, so that the user has to take the cleaning agent from the supply device 40 and then clean his hands by water released from the faucet 50 that is located far away from the supply device 40, thereby causing inconvenience to the user.

SUMMARY OF THE INVENTION

The primary objective of the present invention is to provide an external supply system comprising a supply device for providing the cleaning agent, and a sensing device for providing the flush water automatically. Another objective of the present invention is to provide an external supply system, wherein the supply device is connected to the sensing device, so that the water flowing outward from the water outlet of the sensing device can synchronously co-operate with the cleaning agent flowing outward from the supply device to wash and clean the object.

A further objective of the present invention is to provide an external supply system, wherein the supply device co-operates with the sensing device to provide the cleaning agent and the flush water synchronously, thereby facilitating the user washing and cleaning the object.

In accordance with the present invention, there is provided an external supply system, comprising a sensing device to provide flush water automatically, and a supply device to provide cleaning liquid, wherein:

the supply device is connected to the sensing device to provide the flush water and the cleaning liquid synchronously.

Further benefits and advantages of the present invention will become apparent after a careful reading of the detailed description with appropriate reference to the accompanying drawings.

DETAILED DESCRIPTION OF THE INVENTION

Figure 1:
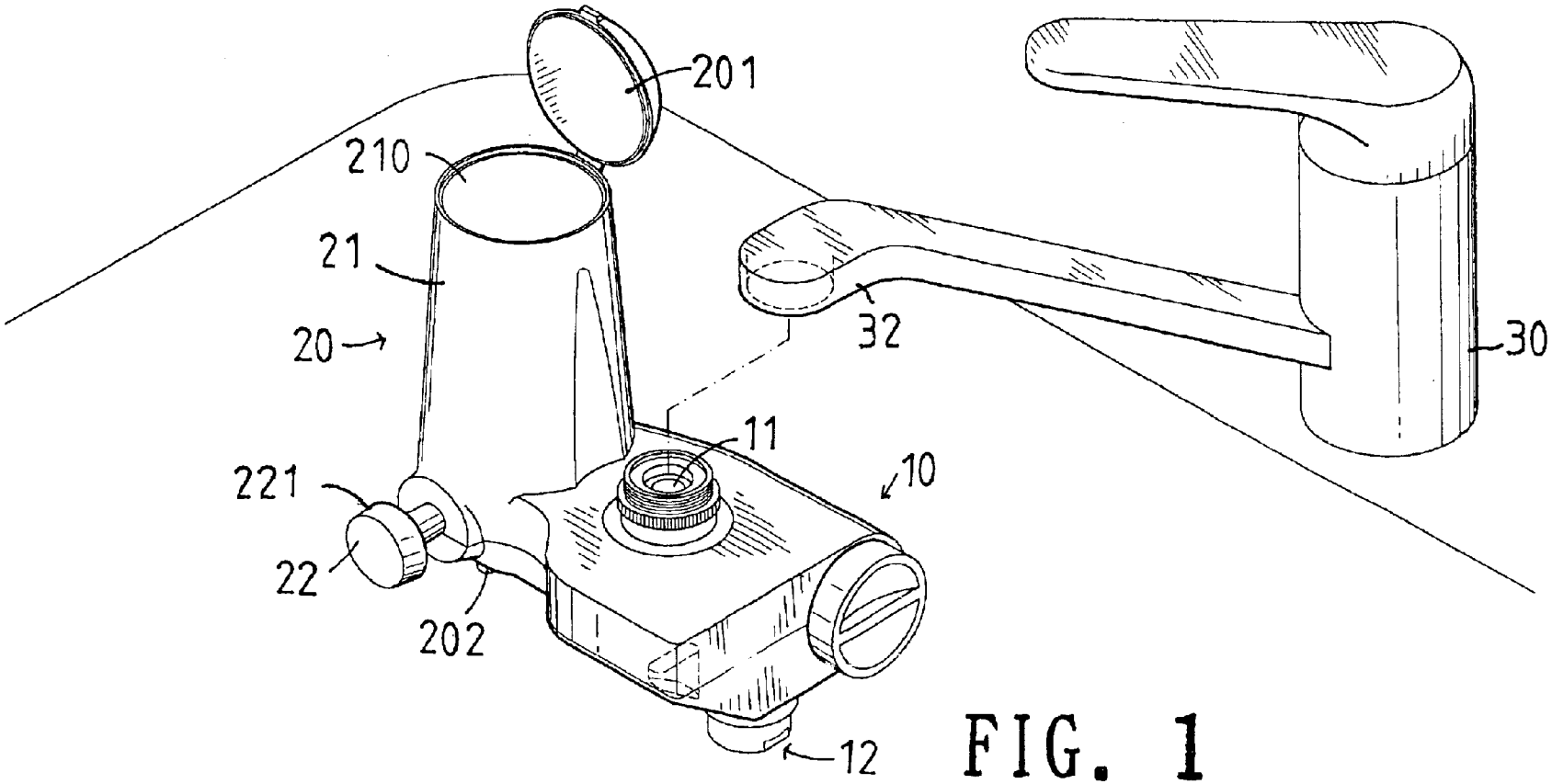
FIG. 1 is a perspective view of an external supply system in accordance with the preferred embodiment of the present invention.
Figure 2:
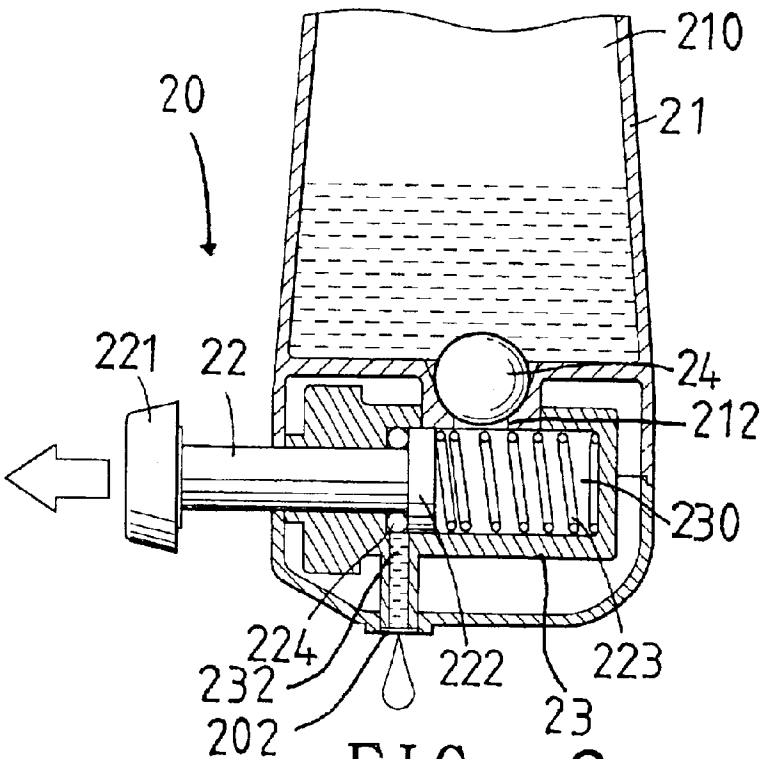
FIG. 2 is a partially cut-away side plan cross-sectional view of the external supply system as shown in FIG. 1.
Figure 3:
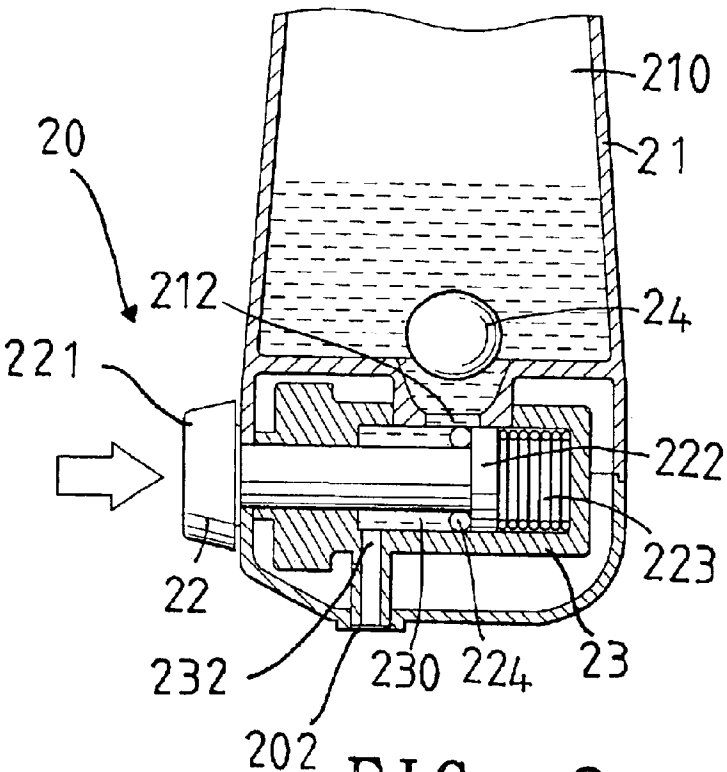
FIG. 3 is a schematic operational view of the external supply system as shown in FIG. 2 in use.

Referring to the drawings and initially to FIGS. 1–3, an external supply system in accordance with the preferred embodiment of the present invention comprises a sensing device 10, and a supply device 20.

The sensing device 10 has a first side provided with a water inlet 11 and a second side provided with a water outlet 12. The water inlet 11 of the sensing device 10 is locked on an outlet 32 of a faucet 30.

The supply device 20 is connected to the sensing device 10. The supply device 20 includes a body 21, a press member 22, an O-shaped sealing member 224, an elastic member 223, and a stop ball 24. The body 21 of the supply device 20 is substantially cylindrical shaped. The body 21 of the supply device 20 has an inside formed with a receiving chamber 210 containing liquid, such as the cleaning agent or the like therein. The body 21 of the supply device 20 has a bottom formed with a drop hole 202 and has a top provided with a transparent cover 201 to facilitate the user replenishing the cleaning agent. The receiving chamber 210 of the body 21 of the supply device 20 has a bottom formed with a connecting hole 212.

The body 21 of the supply device 20 has a lower portion provided with a cylinder 23 having an inside formed with an operation space 230. The operation space 230 of the cylinder 23 has a first side communicating with the receiving chamber 210 through the connecting hole 212 of the receiving chamber 210 and a second side formed with a passage 232 communicating with the drop hole 202 of the body 21.

The press member 22 of the supply device 20 is movably mounted on the body 21 and has a first end 221 protruded outward from the body 21 and a second end 222 slidably mounted in the operation space 230 of the cylinder 23. The second end 222 of the press member 22 has a diameter flush with that of the operation space 230 of the cylinder 23.

The sealing member 224 of the supply device 20 is mounted on the press member 22 to move therewith and is rested on a first side of the second end 222 of the press member 22.

The elastic member 223 of the supply device 20 is mounted in the operation space 230 of the cylinder 23 and is rested on the press member 22 to press the press member 22 to move the sealing member 224.

Thus, the sealing member 224 is driven by the press member 22 to move between a first position as shown in FIG. 2 where the sealing member 224 closes and seals the passage 232, thereby disconnecting the operation space 230 of the cylinder 23 with the drop hole 202 of the body 21, and a second position as shown in FIG. 3 where the sealing member 224 is detached from the passage 232, thereby connecting the operation space 230 of the cylinder 23 with the drop hole 202 of the body 21.

The elastic member 223 of the supply device 20 has a first end rested on a second side of the second end 222 of the press member 22 and a second end rested on a side of the operation space 230 of the cylinder 23.

The stop ball 24 of the supply device 20 is movably mounted in the connecting hole 212 of the receiving chamber 210 of the body 21.

In operation, the press member 22 is initially pressed by the elastic member 223 to move outward, so that the sealing member 224 is driven by the press member 22 to move to the first position as shown in FIG. 2 where the sealing member 224 closes and seals the passage 232, thereby disconnecting the operation space 230 of the cylinder 23 with the drop hole 202 of the body 21, thereby preventing the cleaning agent from flowing outward through the passage 232 and the drop hole 202. At the same time, the stop ball 24 seals the connecting hole 212 of the receiving chamber 210 of the body 21, so that the cleaning agent contained in the receiving chamber 210 of the body 21 will not enter the operation space 230 of the cylinder 23.

On the contrary, when the press member 22 is pressed by the user to move inward, the sealing member 224 is driven by the press member 22 to move to the second position as shown in FIG. 3 where the sealing member 224 is detached from the passage 232, thereby connecting the operation space 230 of the cylinder 23 with the drop hole 202 of the body 21.

At the same time, the operation space 230 of the cylinder 23 produces a pressure to push the stop ball 24 upward during movement of the press member 22, thereby detaching the stop ball 24 from the connecting hole 212 of the receiving chamber 210 of the body 21 and thereby connecting the receiving chamber 210 of the body 21 with the operation space 230 of the cylinder 23, so that the cleaning agent contained in the receiving chamber 210 of the body 21 can enter the operation space 230 of the cylinder 23 through the connecting hole 212.

Figure 4:
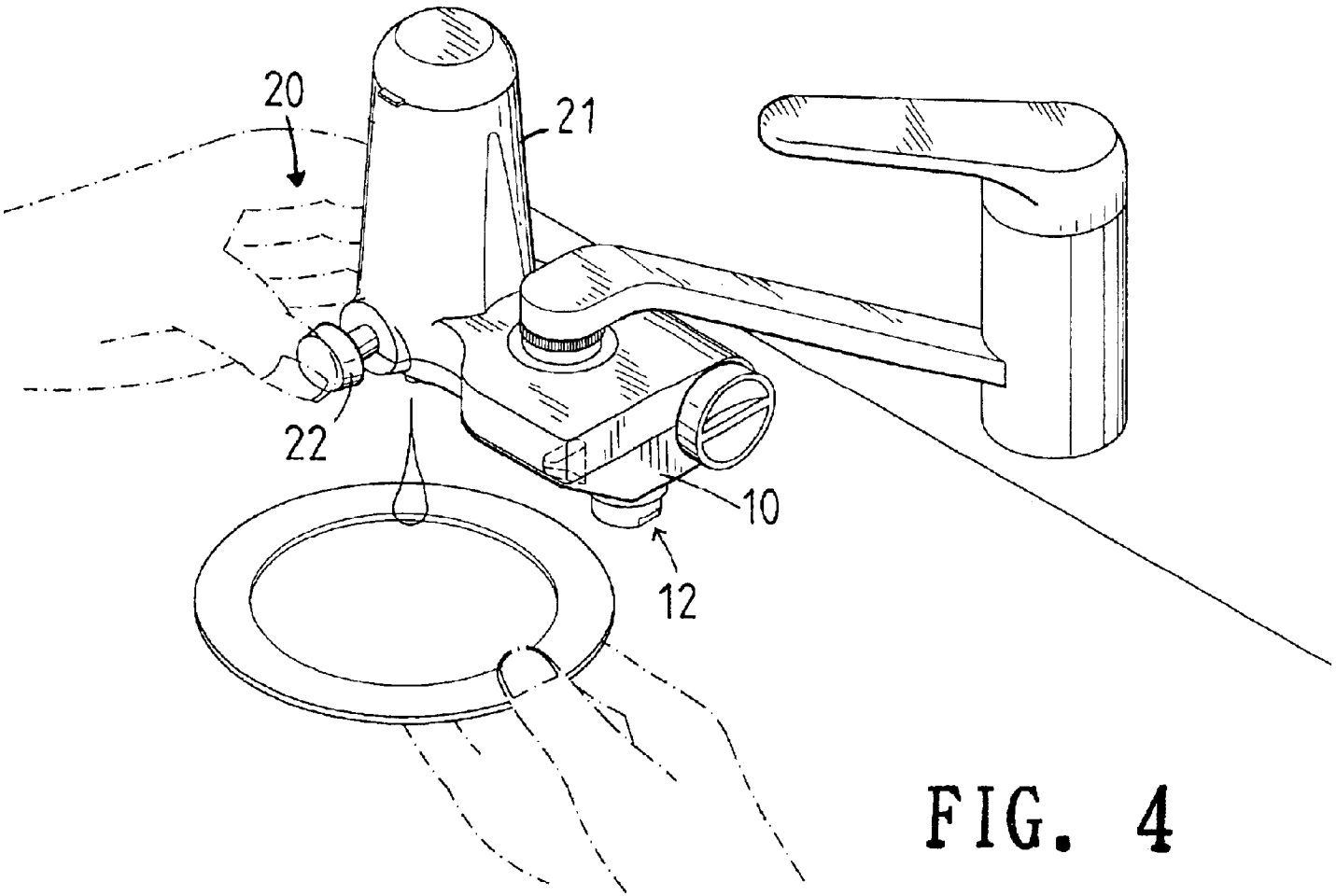
FIG. 4 is a schematic operational view of the external supply system as shown in FIG. 1 in use.

After the press force applied on the press member 22 is removed, the press member 22 is pressed by the restoring force of the elastic member 223 to move outward, so that the sealing member 224 and the cleaning agent are pressed by the second end 222 of the press member 22 to move to the first position as shown in FIG. 2, thereby squeezing the cleaning agent outward through the passage 232 and the drop hole 202 as shown in FIGS. 2 and 4.

Figure 5:
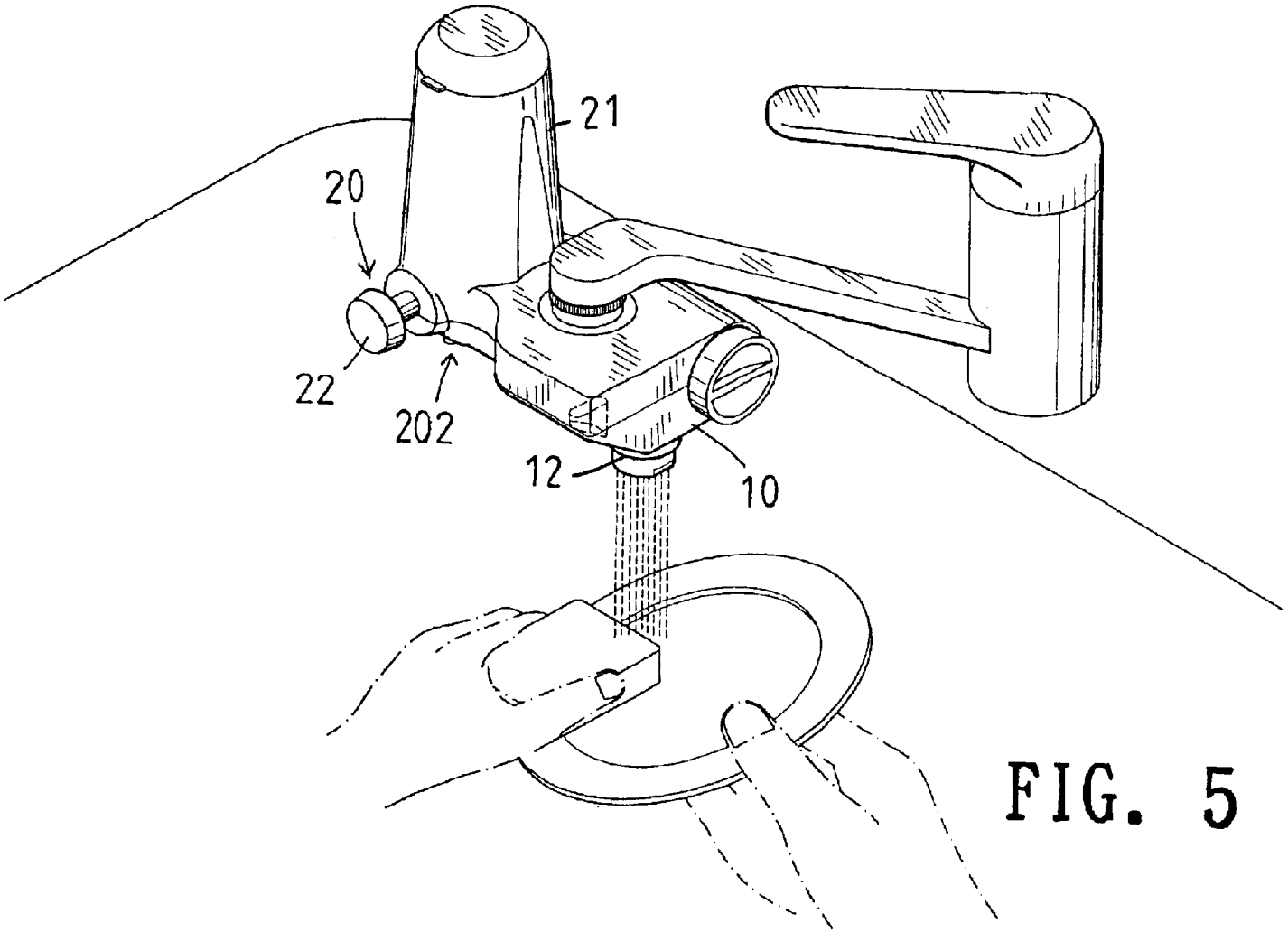
FIG. 5 is a schematic operational view of the external supply system as shown in FIG. 1 in use.
Figure 6:
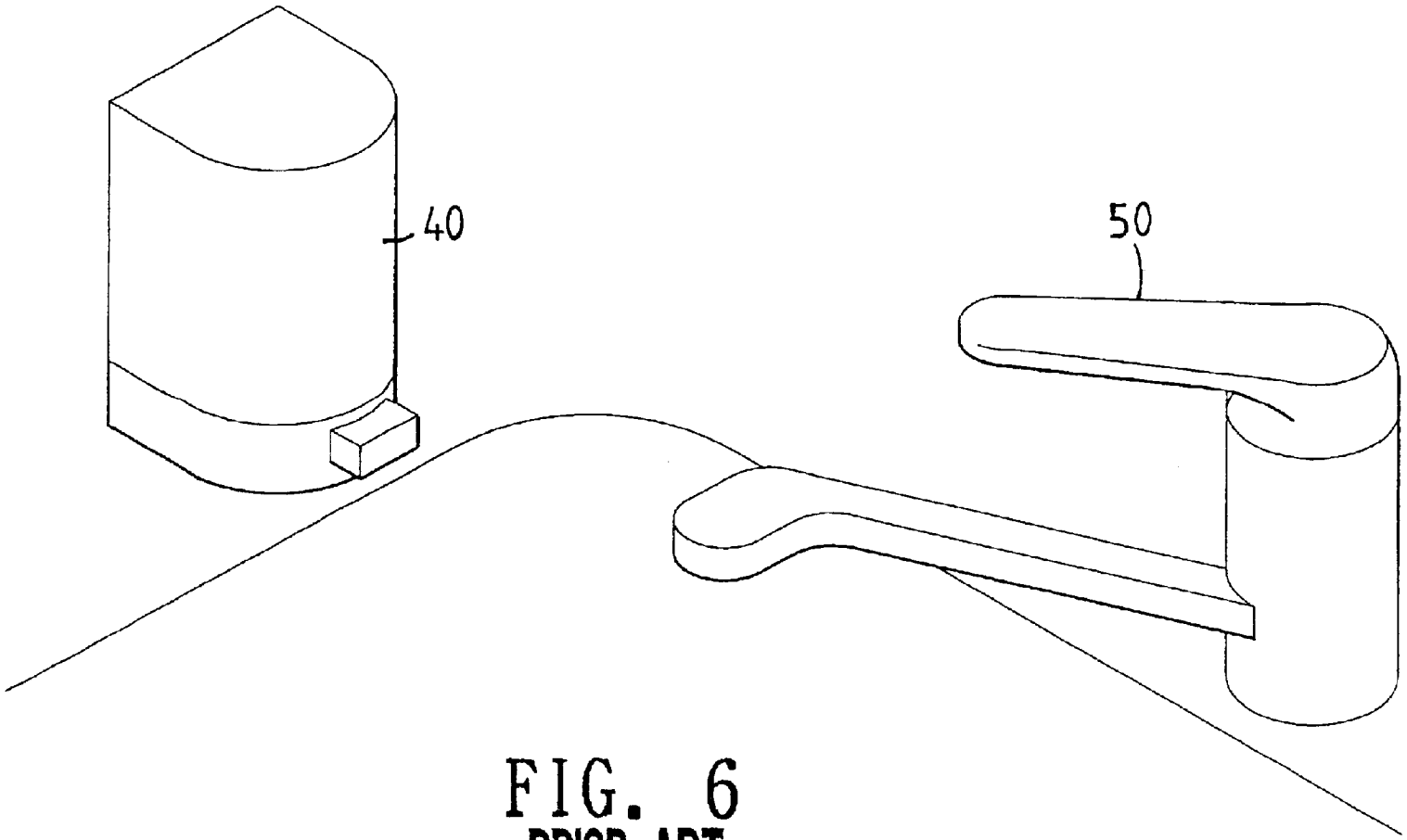
FIG. 6 PRIOR ART
FIG. 6 is a perspective view of a conventional supply device in accordance with the prior art.

When the sensing device 10 detects existence of an object, the sensing device 10 sends a signal to an electromagnetic valve (not shown) which controls the water to flow outward from the water outlet 12 of the sensing device 10 as shown in FIG. 5, so as to co-operate with the cleaning agent flowing outward from the supply device 20 to wash and clean the object.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An external supply system, comprising a sensing device to provide flush water automatically, and a supply device to provide cleaning liquid, wherein the supply device is connected to the sensing device to provide the flush water and the cleaning liquid synchronously;

the supply device includes a body having an inside formed with a receiving chamber containing the cleaning liquid and having a bottom formed with a drop hole, and a press member movably mounted on the body to connect or disconnect the receiving chamber with the drop hole;

the body of the supply device has a lower portion provided with a cylinder having an inside formed with an operation space, the operation space of the cylinder has a first side communicating with the receiving chamber and a second side communicating with the drop hole of the body, and the press member of the supply device has a first end protruded outward from the body and a second end slidably mounted in the operation space of the cylinder;

the first side of the operation space of the cylinder communicates with the receiving chamber through the connecting hole of the receiving chamber;

the second side of the operation space of the cylinder is formed with a passage communicating with the drop hole of the body;

the second end of the press member has a diameter flush with that of the operation space of the cylinder;

the supply device further includes a sealing member mounted on the press member to move therewith and rested on a first side of the second end of the press member, so that the sealing member is driven by the press member to move between a first position where the sealing member closes and seals the drop hole of the body, thereby disconnecting the operation space of the cylinder with the drop hole of the body, and a second position where the sealing member is detached from the drop body, thereby connecting the operation space of the cylinder with the drop hole of the body;

the supply device further includes an elastic member mounted in the operation space of the cylinder and rested on the press member to press the press member to move the sealing member;

the elastic member of the supply device has a first end rested on a second side of the second end of the press member and a second end rested on a side of the operation space of the cylinder;

the receiving chamber of the body of the supply device has a bottom formed with a connecting hole communicating with the operation space of the cylinder, and the supply device further includes a stop ball movably mounted in the connecting hole of the receiving chamber of the body;

the body of the supply device has a top provided with a transparent cover to facilitate the user replenishing the cleaning agent; and the sensing device has a first side provided with a water inlet and a second side provided with a water outlet.

* * * * *